US005107281A

United States Patent [19]

Takahashi

[11] Patent Number: 5,107,281

[45] Date of Patent: Apr. 21, 1992

[54] INK JET RECORDING HEAD HAVING MEANS TO REMOVE STAGNANT BUBBLES

[75] Inventor: Hiroto Takahashi, Yokohama, Japan

[73] Assignee: Canon Kabushiki Kaisha, Tokyo, Japan

[21] Appl. No.: 690,400

[22] Filed: Apr. 25, 1991

Related U.S. Application Data

[63] Continuation of Ser. No. 367,196, Jun. 15, 1989, abandoned.

[30] Foreign Application Priority Data

Jun. 21, 1988 [JP] Japan ..... 63-151080

[51] Int. Cl.[5] ..... B41J 2/18; B41J 2/19; B41J 2/05

[52] U.S. Cl. ..... 346/140 R

[58] Field of Search ..... 346/140

[56] References Cited

U.S. PATENT DOCUMENTS

| | | | |
|---|---|---|---|
| 4,007,465 | 2/1977 | Chaudhary | 346/140 R |
| 4,380,770 | 4/1983 | Maruyama | 346/140 R |
| 4,432,003 | 2/1984 | Barbero | 346/140 |
| 4,568,953 | 2/1986 | Aoki | 346/140 |
| 4,727,378 | 2/1988 | Le | 346/1.1 |
| 4,752,787 | 6/1988 | Matsumoto et al. | 346/140 R |

FOREIGN PATENT DOCUMENTS

| | | |
|---|---|---|
| 2648079 | 5/1977 | Fed. Rep. of Germany . |
| 3224081 | 1/1983 | Fed. Rep. of Germany . |
| 2139564 | 11/1984 | United Kingdom . |

OTHER PUBLICATIONS

Janeway, III, D. L., Bubble Scrubbing in an Inkjet Printing Head, IBM TDB, vol. 22, No. 2, Jul. 1979, p. 501-502.

*Primary Examiner*—Joseph W. Hartary

*Attorney, Agent, or Firm*—Fitzpatrick, Cella, Harper & Scinto

[57] ABSTRACT

An ink jet recording head having a discharge port for discharging ink therethrough comprises a liquid path communicating with the discharge port having a portion in which energy available for discharging the ink acts on the ink, an energy generating member for generating discharge energy, a liquid chamber capable of storing the ink therein and in which the opening portion of the liquid path is provided, and a pair of communication holes for communicating the interior of the liquid chamber with the outside thereof, at least a portion of the ceiling of the liquid chamber is provided at a level higher than the ceiling of the liquid path. Liquid flows in one of the communication holes as a liquid flow inlet and the liquid flows out the other communication hole as a liquid flow outlet. There is provided a guide wall which, when a flow of the liquid is formed between the communication holes, provides a hindrance to the liquid flow rectilinearly linking the communication holes together and guides the flow of the liquid toward the opening portion of the liquid path in the liquid chamber.

9 Claims, 2 Drawing Sheets

INK JET RECORDING HEAD HAVING MEANS TO REMOVE STAGNANT BUBBLES

This application is a continuation of application Ser. No. 07/367,196, filed June 15, 1989, now abandoned.

BACKGROUND OF THE INVENTION

1. Field of the Invention

This invention relates to a recording head for use in an ink jet recording apparatus which discharges ink and forms droplets of the ink and causes them to adhere to a recording medium such as paper to thereby accomplish recording.

2. Related Background Art

The ink jet recording method is a recording method whereby ink (recording liquid) is discharged from a discharge port provided in a recording head to form ink droplets, which are caused to adhere to a recording medium such as paper to thereby accomplish recording. This method has numerous advantages such as very little noise occurs high-speed recording is possible and it is not necessary to use any recording paper of special construction but recording is possible on plain paper or the like. Thus, various types of recording heads have been developed.

Regarding the ink discharge system in this ink jet recording method, mention can be made of various systems such as a system using a piezo-electric element as an ink discharge energy generating member, a system which utilizes a change in the pressure in a liquid path caused by the deformation of a piezo-electric element, or a system in which pressurized ink is vibrated by a piezo-electric element to provide a liquid droplet flow and electric charge is imparted thereto by an electrode and only those of liquid droplets which are necessary are deflected to thereby accomplish recording. Another system uses a heat generating element as an ink discharge energy generating member wherein a heat generating element is provided in a liquid path and ink is suddenly heated and liquid droplets are discharged by the force of a resultant bubble.

The typical construction of the vicinity of a discharge liquid droplet forming portion in a case where an electro-thermal converting member is used as heat energy generating means as the discharge energy generating member of a recording head is shown in the cross-sectional view of FIG. 1 of the accompanying drawings.

This recording head is of a construction in which an electro-thermal converting member having a pair of electrodes 3 formed of Al or like material and a heat generating resistance member 9 formed of $HfB_2$ or like material for generating heat energy for discharging ink is disposed on a substrate 1 of Si or the like having its surface oxidized. A protective layer 4 formed of $SiO_2$ or the like is provided on top of the heat generating resistance member 9 and the electrodes 3 positioned below a liquid path 6 and a liquid chamber 11 and a top plate 5 formed of resin, glass or the like in which the liquid path 6 and the liquid chamber 11 are formed is joined to the protective layer 4. (See U.S. Pat. Nos. 4,723,129, 4,740,796 and 4,417,251).

The ink discharge energy in this recording head is provided by the electro-thermal converting member having the pair of electrodes 3 and the heat generating resistance member 9 positioned between these electrodes. That is, when an electric current is applied to the electrodes 3 to cause the heat generating resistance member 9 to generate heat, the ink in the liquid path 6 near the heat generating resistance member 9 is momentarily heated to create a bubble and the ink is discharged from a discharge port 7 by a change in the volume of the ink from the momentary expansion and contraction of the volume of the ink caused by the creation of the bubble and its subsequent disappearance.

In the recording head of this type, an anticavitation layer is provided on top of the heat generating resistance member 9 and a heat accumulating layer is provided therebelow, as required. Also, in this example, the liquid path 6 and the discharge port 7 are provided in such positional relationship that the direction of flow of the ink in the liquid path 6 is the same as the direction of discharge of an ink droplet from the discharge port 7, but in some cases, these are disposed so that these directions differ from each other (See U.S. Pat. No. 4,459,600).

The recording head of the construction as described above has suffered from the problem that when a bubble remains when the ink is supplied into the liquid chamber, or when a new bubble is created during the use of the recording head and it stagnates near the opening portion in the liquid chamber in the liquid path communicating with the discharge port, unsatisfactory discharge of the ink from the discharge port occurs. Particularly, in a recording head using the heat generating resistance member as described above, the temperature of the ink in the head rises due to heat energy which has not been used for recording and gas having ink dissolved therein is sometimes discharged, and this leads to the tendency of the creation of a bubble being ready to occur.

Also, the ink jet recording head of the construction as described above is formed by a top plate which constitutes a liquid path and a liquid chamber communicating with a discharge port being usually joined to a base plate having a discharge energy generating member, but due to the structure thereof, a level difference is ready to occur in the vicinity of the opening portion of the liquid path in the liquid chamber (for example, the boundary portion between the liquid path 6 and the liquid chamber 11 of FIG. 2B of the accompanying drawings, and a bubble is liable to stagnate particularly there.

So, various means have been adopted against such stagnation of a bubble, but the fact is that a sufficient effect is not always obtained.

For example, there is a method as shown in the schematic plan view of FIG. 2A of the accompanying drawings and the schematic cross-sectional view of FIG. 2B of the accompanying drawings wherein a space **11*a* permitting bubbles to collect therein is provided in the upper portion of a liquid chamber 11 so that bubbles created in the liquid chamber 11 and united together and thereby increased in volume and elevated by their own buoyancy of are contained in the space 11*a*** to thereby eliminate the influence of the bubbles upon the interior of the liquid path, but if the force with which the bubbles adhere to the wall surfaces constituting the liquid chamber and the liquid path is strong, the elevation of the bubbles by their own buoyancy cannot be expected sufficiently and a desired effect cannot be obtained.

So, there is a method wherein a pair of communication holes **10*a* and 10*b* are provided in the liquid chamber 11 so that when the head is used for recording, at least one of the communication holes is utilized as an ink supply port and when the head is not used for recording, ink is caused to flow in from one of the communication holes and ink is caused to flow out from the other communication hole, whereby an ink flow is formed between these communication holes and bubbles adhering to the vicinity of the opening portion of the liquid path 6** are removed by that flow, thereby eliminating the problem as noted above (See U.S. Pat. No. 4,380,770).

However, it has been found that in some cases, even the use of such a method cannot obtain a sufficient effect.

In order to solve such a problem, the inventor has paid his attention to the fact that in the prior-art recording head, no sufficient study has been made about the shape of the liquid chamber which takes the above-mentioned flow between the communication holes into consideration and the positional relation between the communication holes, and has carried out various studies of the shape of the liquid chamber and the liquid flow between the communication holes and as a result, has completed the construction of a liquid chamber which can effectively eliminate any bubble stagnating near the opening portion of the liquid path communicating with the discharge port which is adjacent to the liquid chamber, and has reached the present invention.

SUMMARY OF THE INVENTION

It is an object of the present invention to provide an ink jet recording head having a construction in which the adverse effect of any bubble stagnant in a liquid chamber can be effectively eliminated by a simple operation.

It is also an object of the present invention to provide an ink jet recording head in which guide walls for guiding a liquid flow formed in a liquid chamber are provided in the liquid chamber correspondingly to the opening positions of communication holes available for the formation of a liquid flow for eliminating any bubble and the liquid flow from one of the communication holes which is used as the inlet for the liquid impinges effectively on the vicinity of the opening portion of a liquid path communicating with a discharge port which is adjacent to the liquid chamber, whereby any bubble stagnant there can be effectively removed. In addition, it is an object of the present invention to provide an ink jet recording head in which a space for containing any bubble therein is provided in the upper portion of the liquid chamber and the influence of the bubble upon ink discharge can also be eliminated by the bubble removed from the side surface of the liquid chamber being contained in that space.

It is another object of the present invention to provide an ink jet recording head having a discharge port for discharging ink therethrough, a liquid path communicating with said discharge port and having a portion in which energy for discharging the ink acts on the ink, an energy generating member for generating said discharge energy, a liquid chamber capable of storing the ink therein and in which the opening portion of said liquid path is provided, and a communication hole for communicating the interior of said liquid chamber with the outside, and wherein (a) at least a portion of the ceiling of said liquid chamber is provided at a level higher than the ceiling of said liquid path, and (b) at least one set of said communication holes are provided in said liquid chamber, and liquid is caused to flow in with one of said communication holes as a liquid flow inlet and the liquid is caused to flow out with the other communication hole as a liquid outlet, and there is provided a guide wall which, when a flow of said liquid is formed between said communication holes, provides a hindrance to the liquid flow rectilinearly linking said communication holes together and guides the flow of said liquid toward the opening portion of said liquid path in said liquid chamber.

DESCRIPTION OF THE PREFERRED EMBODIMENTS

An embodiment of the present invention will hereinafter be described with reference to the drawings.

Figure 1:
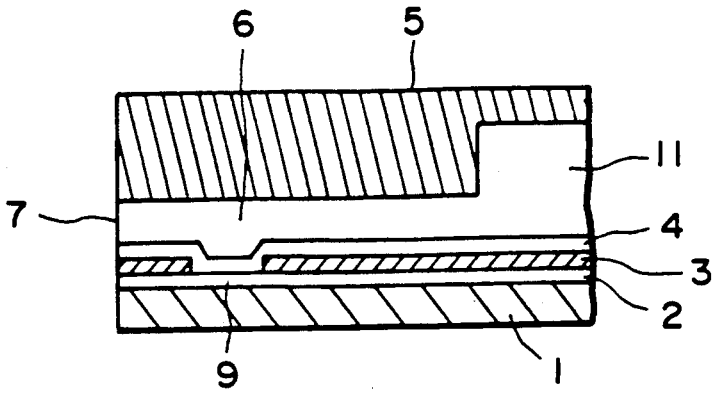
FIG. 1 PRIOR ART
FIG. 1 is a schematic cross-sectional view showing the typical construction of the vicinity of the discharge liquid droplet forming portion of an ink jet recording head.
Figure 2A:
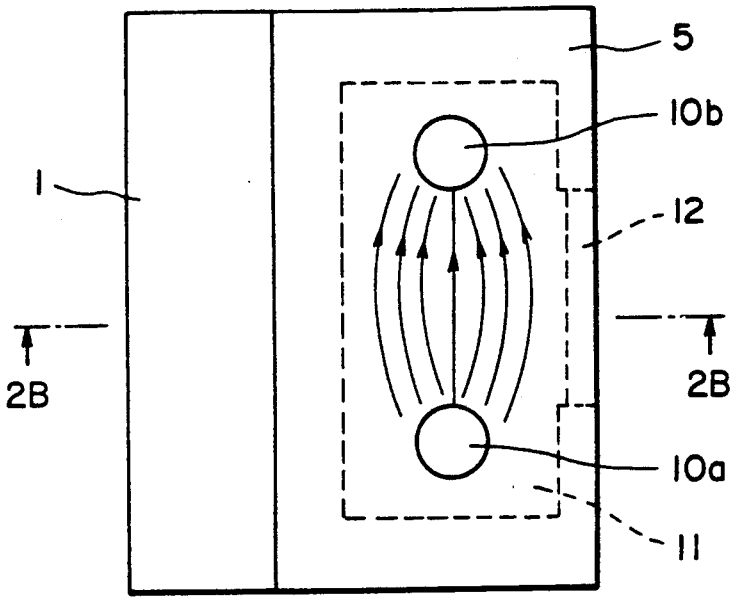
FIG. 2A PRIOR ART
FIGS. 2A and 2B show the construction of the liquid chamber of a recording head according to the prior art, FIG. 2A being a schematic plan view showing the liquid chamber and the discharge liquid droplet forming portion in broken line, and FIG. 2B being a schematic cross-sectional view taken along line 2B—B in FIG. 2A.
Figure 2B:
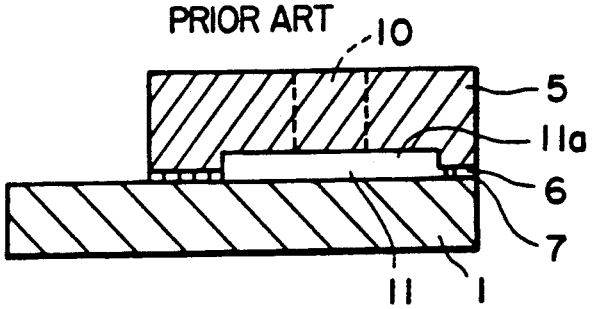
FIG. 2B PRIOR ART
Figure 3A:
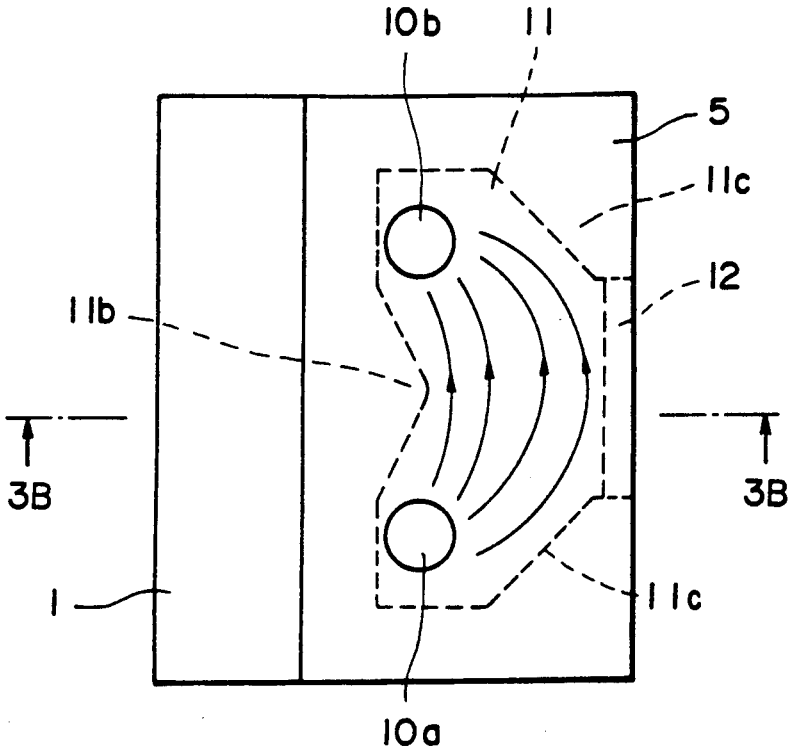
FIGS. 3A and 3B show an embodiment of the ink jet recording head of the present invention, FIG. 3A being a schematic plan view showing a liquid chamber and a discharge liquid droplet forming portion in broken line, and FIG. 3B being a schematic cross-sectional view taken along line 3B—3B in FIG. 3A.
Figure 3B:
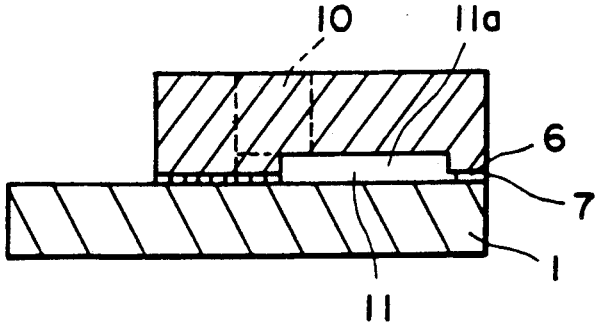

FIGS. 3A and 3B show an embodiment of the ink jet recording head of the present invention, FIG. 3A being a schematic plan view showing a liquid chamber or ink storing area 11 and a discharge liquid droplet forming portion or ink discharge area 12 in broken line, and FIG. 3B being a schematic cross-sectional view taken along line 3B—3B in FIG. 3A.

In the liquid chamber 11 of the ink jet recording head of the present invention, there are provided communication holes or parts **10*a* and 10*b* usable to form a liquid flow for the removal of the above-described bubbles and guide walls 11*b* and 11*c* which provide a hindrance to a liquid flow rectilinearly linking these communication holes together and guide the liquid flow between the communication holes toward the opening portion of a liquid path 6 which is adjacent to the liquid chamber 11**.

Also, at least a portion of the ceiling of the liquid chamber 11 is formed higher than the ceiling of the liquid path 6, and a sufficient space **11*a* for containing bubbles therein is formed in the upper portion of the liquid chamber 11**.

A plurality of discharge ports 7 are provided communicating with the ink discharge area 12. The plurality of discharge ports are arranged in a predetermined linear array. One communication port **10*a* is provided in the vicinity of one end of the predetermined array, while an other communication port 10*b* is provided near the other end of the predetermined array. Guide wall 11*b* is in the form of a projection from the inner wall of the ink storing area 11 and is oriented perpendicular to the array of the ink discharge ports 7. The projection 11*b* is positioned between communication ports 10*a* and 10*b*. A leading edge of the projection 11*b* is opposed to a central portion of the array of the discharge ports. Portions of the inner wall of the ink storing area 11, which surround the communication ports 10***a*, 10*b*, and the projection 11B are integrally formed.

By such a construction, any bubble stagnant in the liquid chamber 11, particularly in the vicinity of the opening portion of the liquid path 6 which is adjacent to the liquid chamber 11 can be effectively removed and the adverse effect thereof upon ink discharge can be eliminated.

That is, when the use of the recording head is temporarily stopped and ink is caused to flow in at a predetermined pressure, for example, from the communication hole 10*a* and is caused to flow out from the communication hole 10*b*, there can be formed an ink flow as indicated by arrows. At that time, by the action of the guide walls 11*b* and 11*c*, the ink flow can be caused to impinge effectively on the vicinity of the opening portion of the liquid path 6 which is adjacent to the liquid chamber 11, and any bubble stagnant there can be removed easily.

On the other hand, the bubble removed from the vicinity of the opening portion of the liquid path 6 which is adjacent to the liquid chamber 11 is contained with the ink flow from the communication hole 10*b* as a liquid flow outlet or is caused to float up into the space 11*a* in the upper portion of the liquid chamber and is contained therein, whereby the influence of the bubble upon ink discharge as described above can be sufficiently eliminated.

The shape of the guide walls, the locations of the communication holes and the structure of the upper portion of the liquid chamber can be suitably chosen in conformity with the construction and function of the recording head such as the number of arrangements of discharge ports and the structure of the liquid path, or the type of the material of the various portions of the recording head, particularly the portions constituting the liquid path communicating with the liquid chamber and the discharge ports, so that the effect as described above may be obtained.

As described above, in the ink jet recording head of the present invention, by the action of the guide walls provided in the liquid chamber, the liquid flow caused in the liquid chamber impinges effectively on the vicinity of the opening portion of the liquid path which is adjacent to the liquid chamber, and any bubble stagnant therein can be removed easily. As a result, the maintenance of a good ink discharge condition and the function recovering process when unsatisfactory discharge due to the stagnation of any bubble occurs become very easy.

Also, the bubble removed by the liquid flow can be contained in the space provided in the upper portion of the liquid chamber and the influence thereof upon ink discharge can be effectively eliminated.

I claim:

1. An ink jet recording head comprising:

an ink discharge area;

an ink storing area adjacent said ink discharge area, said ink storing area having an inner wall;

a first communicating port for supplying ink to said ink storing area;

a second communicating port for exhausting ink from said storing area; and a plurality of discharge ports communicating with said ink discharge area and being arranged in a predetermined array, said array having a first end and a second end, wherein said first communicating port is provided in the vicinity of the first end of the array of said ink discharge ports and said second communicating port is provided in the vicinity of the second end of the array of said ink discharge ports and wherein a part of said inner wall of said ink storing area has a projection oriented perpendicular to the array of said discharge ports and a wall of said projection is positioned between said first and second communicating ports.

2. An ink jet recording head according to claim 1, wherein said ink discharge area is provided with an electrothermal conversion element for generating thermal energy utilized for discharging ink.

3. An ink jet recording head according to claim 1, wherein at least a part of a ceiling of said ink storing area is provided higher than a ceiling of said ink discharge area.

4. An ink jet recording head comprising:

an ink discharge area;

an ink storing area adjacent said ink discharge area, said ink storing area having an inner wall;

a first communicating port for supplying ink to said ink storing area;

a second communicating port for exhausting ink from said ink storing area; and a plurality of discharge ports communicating with said ink discharge area and arranged in a predetermined array, said array having a first end and a second end, wherein said first communicating port is provided in the vicinity of the first end of the array of said ink discharge ports and said second communicating port is provided in the vicinity of the second end of the array of said ink discharge ports and wherein a part of said inner wall of said ink storing area has a projection oriented perpendicular to the array of said discharge ports and a wall of said projection is positioned between said first and second communicating ports, a leading edge of said projection being opposed to a central portion of the array of said discharge ports.

5. An ink jet recording head according to claim 4, wherein said ink discharge area is provided with an electrothermal converting element for generating thermal energy utilized for discharging ink.

6. An ink jet recording head according to claim 4, wherein at least a part of a ceiling of said ink storing area is higher than a ceiling of said ink discharge area.

7. An ink jet recording head comprising:

an ink discharge area;

an ink storing area adjacent said ink discharge area, said ink storing area having an inner wall;

a first communicating port for supplying ink to said ink storing area;

a second communicating port for exhausting ink from said ink storing area; and a plurality of discharge ports communicating with said ink discharge area and arranged in a predetermined array, the array having a first end and a second end, wherein said first communicating port is provided in the vicinity of the first end of the array of said ink discharge ports and said second communicating port is provided in the vicinity of the second end of the array of said ink discharge ports and wherein a first portion of said inner wall of said ink storing area partially surrounding said first communicating port, a second portion of said inner wall of said ink storing area partially surrounding said second communicating port and a wall of a projection of said inner wall positioned between said first and second communicating ports are continuously formed opposing the array of said ink discharge ports, said projection being opposed to a central portion of the array of said discharge ports.

8. An ink jet recording head according to claim 7, wherein said ink discharge area is provided with an electrothermal converting element for generating thermal energy utilized for discharging ink.

9. An ink jet recording head according to claim 7, wherein at least a part of a ceiling of said ink storing area is higher than a ceiling of said ink discharge area.

* * * * *

UNITED STATES PATENT AND TRADEMARK OFFICE

CERTIFICATE OF CORRECTION

PATENT NO. : 5,107,281

DATED : April 21, 1992

INVENTOR(S) : HIROTO TAKAHASHI

It is certified that error appears in the above-identified patent and that said Letters Patent is hereby corrected as shown below:

COLUMN 1

Line 22, "occurs high-speed" should read --occurs, high-speed--.

COLUMN 2

Line 57, "of" should be deleted.

COLUMN 4

Line 21, "line 2B—B" should read --line 2B—2B--.
Line 42, "parts" should read --ports--.
Line 59, "an" should read --an- --.

COLUMN 5

Line 2, "11B" should read --11b--.
Line 62, "said storing area;" should read --said ink storing area;--.

Signed and Sealed this

Thirty-first Day of August, 1993

Bruce Lehman

*Attest:*

BRUCE LEHMAN

*Attesting Officer*

*Commissioner of Patents and Trademarks*